US009372445B2

(12) United States Patent
Mori et al.

(10) Patent No.: US 9,372,445 B2
(45) Date of Patent: Jun. 21, 2016

(54) IMAGE FORMING APPARATUS

(71) Applicant: CANON KABUSHIKI KAISHA, Tokyo (JP)

(72) Inventors: Hideki Mori, Toride (JP); Keiko Fujita, Kashiwa (JP); Hiroshi Saito, Toride (JP); Hitoshi Kubota, Tokyo (JP); Tohru Nakaegawa, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/505,537

(22) Filed: Oct. 3, 2014

(65) Prior Publication Data

US 2015/0055992 A1 Feb. 26, 2015

Related U.S. Application Data

(63) Continuation of application No. PCT/JP2013/060760, filed on Apr. 3, 2013.

(30) Foreign Application Priority Data

Apr. 3, 2012 (JP) ..... 2012-084973
Mar. 29, 2013 (JP) ..... 2013-073275

(51) Int. Cl.
*G03G 15/01* (2006.01)
*G03G 15/16* (2006.01)

(52) U.S. Cl.
CPC ..... *G03G 15/1615* (2013.01); *G03G 15/0136* (2013.01); *G03G 15/0189* (2013.01); *G03G 2215/0132* (2013.01); *G03G 2215/0193* (2013.01)

(58) Field of Classification Search
CPC ..... G03G 15/1625; G03G 2215/0122; G03G 2215/0119; G03G 2215/0125; G03G 15/1615; G03G 15/0136
USPC ..... 399/302
See application file for complete search history.

(56) References Cited

U.S. PATENT DOCUMENTS 5,933,687 A * 8/1999 Okuno et al. ..... 399/167
6,618,565 B2 9/2003 Tamiya et al.

(Continued)

FOREIGN PATENT DOCUMENTS

CN 101201577 A 6/2008
JP 2001-175092 A 6/2001

(Continued)

OTHER PUBLICATIONS

Search Report issued in European Patent Application No. 13772810.1, dated Nov. 20, 2015.

(Continued)

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

In a constitution provided with no primary-transfer roller, in order to ensure a contact length between each of photosensitive drums and an intermediary transfer belt, the photosensitive drums are disposed with projecting amounts of a plurality of levels with respect to a stretching surface of the intermediary transfer belt, and therefore an apparatus is liable to be increased in a height direction. In order to avoid this, four image bearing members are arranged, along the intermediary transfer belt, with the same projection amount with respect to the stretching surface of the intermediary transfer belt, and a depressing member for depressing a belt surface between two central image bearing members toward an outside is provided.

17 Claims, 11 Drawing Sheets

(56) References Cited

U.S. PATENT DOCUMENTS

| | | | | |
|---|---|---|---|---|
| 6,760,562 | B2 | 7/2004 | Nishida et al. | |
| 6,829,450 | B2 | 12/2004 | Tamiya et al. | |
| 2008/0145084 | A1 * | 6/2008 | Toizumi et al. | 399/66 |
| 2015/0168879 | A1 | 6/2015 | Mori et al. | |

FOREIGN PATENT DOCUMENTS

| | | | | | |
|---|---|---|---|---|---|
| JP | 2001-265135 | A | | 9/2001 | |
| JP | 2003-035986 | A | | 2/2003 | |
| JP | 2004-021188 | A | | 1/2004 | |
| JP | 2004-287268 | A | | 10/2004 | |
| JP | 2005-091613 | A | | 4/2005 | |
| JP | 2005091613 | A | * | 4/2005 | G03G 15/01 |
| JP | 2005-199657 | A | | 7/2005 | |
| JP | 2006-259640 | A | | 9/2006 | |
| JP | 2007-003634 | A | | 1/2007 | |
| JP | 3959224 | B2 | | 8/2007 | |
| JP | 2008-170968 | A | | 7/2008 | |

OTHER PUBLICATIONS

Office Action issued in Korean Patent Application No. 10-2014-7029878, dated Nov. 30, 2015.

Office Action issued in Chinese Application No. 201380022726.9 dated Jan. 29, 2016.

Office Action issued in Russian Patent Application No. 2014144264/28, dated Jan. 27, 2016.

* cited by examiner (a)

(b)

| | ENV. 1 | ENV. 2 | ENV. 3 | ENV. 4 | ENV. 5 | ENV. 6 | ENV. 7 |
|---|---|---|---|---|---|---|---|
| Y,M,C | 350 | 375 | 400 | 425 | 450 | 475 | 500 |
| Bk | 370 | 400 | 430 | 460 | 490 | 520 | 550 |

IMAGE FORMING APPARATUS

TECHNICAL FIELD

The present invention relates to an image forming apparatus of an electrophotographic type, such as a copying machine, a printer, a facsimile machine or the like. The present invention relates to the image forming apparatus in which toner images are superposedly transferred from a plurality of image bearing members onto an intermediary transfer member, and then are transferred from the intermediary transfer member onto a recording material.

In an electrophotographic type image forming apparatus, in order to meet various recording materials, an intermediary transfer type is known, in which a toner image is transferred from a photosensitive member onto an intermediary transfer member (primary-transfer) and then is transferred from the intermediary transfer member onto the recording material (secondary-transfer) to form an image.

Japanese Laid-Open Patent Application No. 2003-35986 discloses a conventional constitution of the intermediary transfer type. More particularly, in Japanese Laid-Open Patent Application No. 2003-35986, in order to primary-transfer the toner image from the photosensitive member onto the intermediary transfer member, a primary transfer roller is provided, and a voltage source (power source) exclusively for the primary-transfer is connected to the primary transfer roller. Furthermore, in Japanese Laid-Open Patent Application No. 2003-35986, in order to secondary-transfer the toner image from the intermediary transfer member onto the recording material, a secondary transfer roller is provided, and a voltage source exclusively for the secondary-transfer is connected to the secondary transfer roller.

In Japanese Laid-Open Patent Application No. 2006-259640, there is a constitution in which a voltage source is connected to an inner secondary-transfer roller, and another voltage source is connected to the outer secondary-transfer roller. In Japanese Laid-Open Patent Application No. 2006-259640, there is description to the effect that the primary-transfer of the toner image from the photosensitive member onto the intermediary transfer member is effected by voltage application to the inner secondary-transfer roller by the voltage source. Further, a constitution in which photosensitive members are caused to enter an intermediary transfer belt flat surface (plane) in entering amounts at two levels such that the entering amount of two inside photosensitive members is made larger than the entering amount of two outside photosensitive members with respect to the intermediary transfer belt flat surface created by stretching rollers provided at both ends is disclosed.

In Japanese Laid-Open Patent Application No. 2004-21188, there is a method in which a member (roller) for depressing the intermediary transfer belt from an inner surface is disposed between respective image bearing members (photosensitive drums). That is, three depressing members are disposed for four image bearing members.

However, in the constitution provided with no primary-transfer roller described in FIG. 5 of Japanese Laid-Open Patent Application No. 2006-259640, a primary-transfer efficiency is lowered unless a contact length in which the photosensitive drum contacts the intermediary transfer belt with respect to a rotational direction of the photosensitive drum is large to some extent.

SUMMARY OF THE INVENTION

Problem to be Solved by the Invention

In Japanese Laid-Open Patent Application No. 2006-259640, the photosensitive drums are disposed so as to ensure the contact length of the respective photosensitive drums by setting the entering amounts at the two levels with respect to the intermediary transfer belt stretching surface, and therefore there is a problem that the apparatus is upsized in the height direction.

Further, in the constitution of Japanese Laid-Open Patent Application No. 2004-21188, there are the three depressing members, and therefore there is a problem that an effect of cost reduction by reducing components by omission of the primary-transfer roller is decreased.

Means for Solving the Problem

The present invention provides an image forming apparatus comprising: a movable endless intermediary transfer belt; a plurality of supporting rollers, including a driving roller for driving the intermediary transfer belt, for supporting the intermediary transfer belt; first to fourth photosensitive drums which are arranged along the intermediary transfer belt between a first supporting roller and a second supporting roller of the plurality of supporting rollers in the order of the first photosensitive drum, the second photosensitive drum, the third photosensitive drum and the fourth photosensitive drum from an upstream side toward a downstream side with respect to a direction in which the intermediary transfer belt moves, and which contact the intermediary transfer belt; wherein toner images transferred from the first, second, third and fourth photosensitive drums on the intermediary transfer belt at first, second, third and fourth transfer portions, respectively, are transferred from the intermediary transfer belt onto a recording material, wherein the first to fourth photosensitive drums are disposed at positions where a plane of the intermediary transfer belt is disposed inwardly of a phantom common tangential line, of the first supporting roller and the second supporting roller, formed in a photosensitive drum side in a plane perpendicular to rotation centers of the photosensitive drums; and a depressing member for outwardly depressing the plane of the intermediary transfer belt between the second photosensitive drum and the third photosensitive drum.

Effect of the Invention

By the present invention, it becomes possible to suppress a height of the apparatus to a low level while ensuring a contact length in which each photosensitive drum contacts the intermediary transfer belt.

EMBODIMENTS FOR CARRYING OUT THE INVENTION

Embodiment 1

Figure 1:
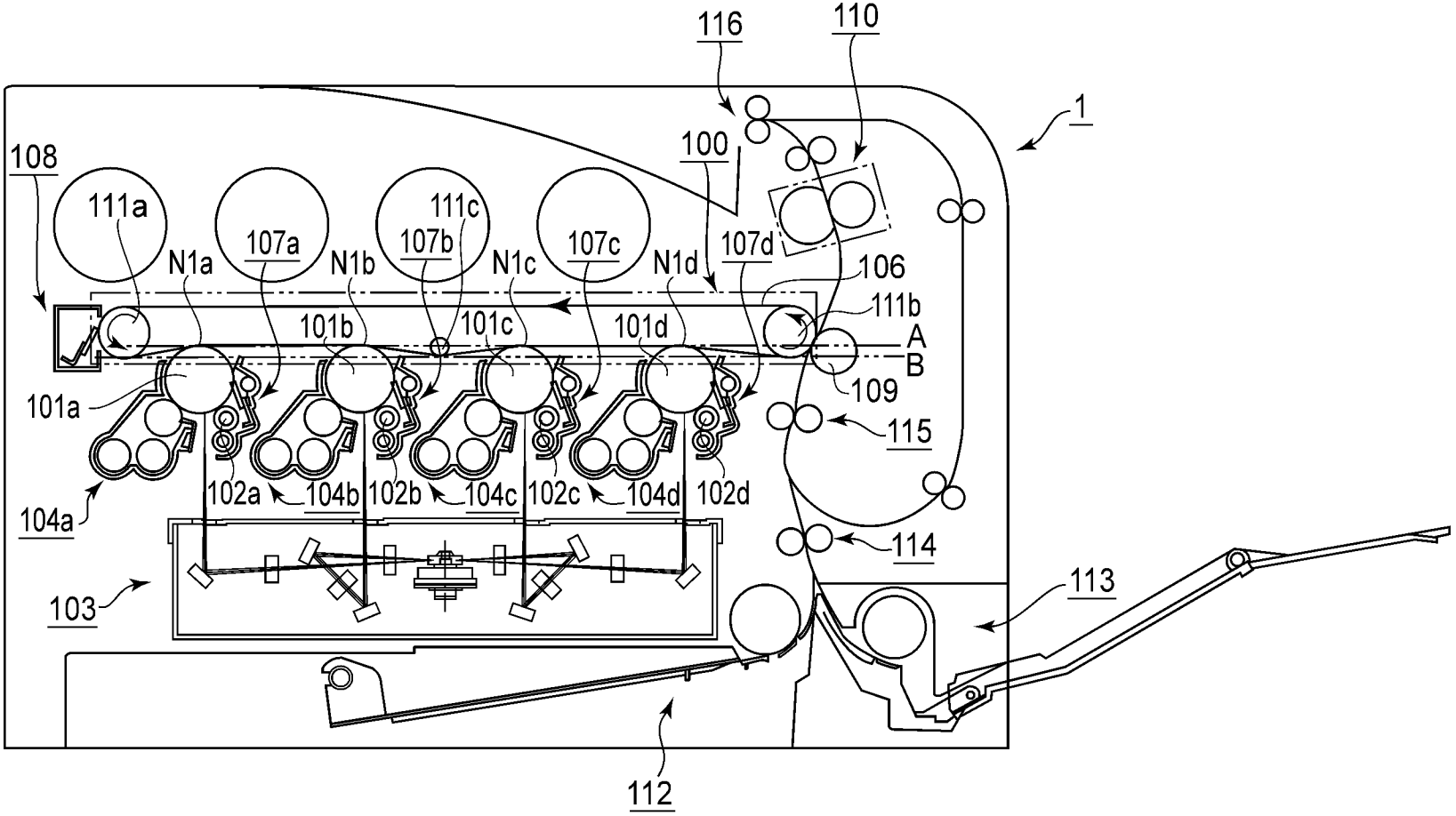
FIG. 1 is a sectional view of a color digital printer shown as Embodiment 1.

FIG. 1 is a schematic structural view of a color digital printer as an example of an image forming apparatus (a tandem-type full-color image forming apparatus of an electrophotographic type in this embodiment) according to Embodiment 1.

In FIG. 1, four photosensitive drums 101*a*-101*d* (first to fourth photosensitive drums) are photosensitive drums as image bearing members. The surfaces thereof are electrically charged to uniform electric charges by charging rollers 102*a*-102*d* (charging means), respectively. Into a laser scanner 103, image signals for yellow (Y), magenta (M), cyan (C) and black (K) are inputted. Depending on this image signal, the laser scanner 103 (exposure means) irradiates each of the charged photosensitive drum surfaces with laser light to neutralize the electric charges, thus forming an electrostatic image. Developing devices 104*a*, 104*b*, 104*c* and 104*d* incorporate toners of yellow (Y), magenta (M), cyan (C) and black (K), respectively, as developing means for developing the electrostatic images. The electrostatic images formed on the photosensitive drums are developed with the toners of yellow, magenta, cyan and black by the developing devices 104*a*, 104*b*, 104*c* and 104*d*. Toner images formed on the respective photosensitive drums are primary-transferred onto an intermediary transfer belt 6. Incidentally, this embodiment employs a constitution provided with no primary-transfer roller. The intermediary transfer belt is an endless belt-shaped intermediary transfer member onto which the toner images are to be transferred, and is supported from an inside by supporting rollers 111*a* (first supporting roller) and 111*b* (second supporting roller) as supporting members. Incidentally, along a direction in which the intermediary transfer belt moves, the supporting roller 111*a*, the photosensitive drums 101*a*, 101*b*, 101*c* and 101*d*, and the supporting roller 111*b* are disposed in the listed order. That is, the photosensitive drum 101*a* (first image bearing member) is disposed in an upstreammost side, and the photosensitive drum 101*b* (second image bearing member) is disposed in a downstream side of the photosensitive drum 101*a*. The photosensitive drum 101*c* (third image bearing member) is disposed in a downstream side of the photosensitive drum 101*b*, and the photosensitive drum 104*d* (fourth image bearing member) is disposed in a downstream side of the photosensitive drum 101*c*. Although will be described later, 111*a* is a roller (first supporting) member disposed, in an upstream side of the photosensitive drum 101*a*, at a position where a distance with the photosensitive drum 101*a* is shortest. 111*b* is a roller (second supporting member) disposed, in a downstream side of the photosensitive drum 101*d*, at a position where a distance with the photosensitive drum 101*d* is shortest. The toner images of the respective colors are transferred superposedly onto the intermediary transfer belt 106, so that a full-color toner image is formed on the intermediary transfer belt 106. Transfer residual toners remaining on the photosensitive drums without being transferred onto the intermediary transfer belt are collected by drum cleaners 107*a*-107*d*. These image forming operations are controlled by a controller 800.

On the other hand, a recording material is accommodated in a paper feeding cassette 112. Or, the recording material is set in a manual feeding portion 113. The recording material is fed from either of the paper feeding cassette 112 and the manual feeding portion 113, and is conveyed toward registration rollers 115 by conveying rollers 114. A leading end of the recording material abuts against the registration rollers 115 in a rest state, so that a loop is formed. Thereafter, the recording material is conveyed by the registration rollers 115 at timing of synchronization with the toner images on the intermediary transfer belt 6.

In a downstream side from the registration rollers with respect to a recording material conveyance direction, an outside (outer) secondary-transfer roller 109 as a transfer member for forming a secondary-transfer portion, where the toner image is transferred onto the recording material, while opposing the roller 11*b* for supporting the intermediary transfer belt is disposed. That is, the supporting roller 101*b* functions as an inner secondary-transfer roller. Further, the supporting roller 111*b* functions also as a driving roller for driving the intermediary transfer belt 106 by receiving a driving force from a motor.

When the recording material is conveyed to a secondary-transfer portion, a voltage is applied to the outside secondary-transfer roller 109 by a voltage source (pour source), whereby the toner image on the intermediary transfer belt 106 is transferred onto the recording material by the outside secondary-transfer roller 109. Thereafter, the toner image is heated and pressed by a fixing device 110 and then is fixed on the recording material. Thereafter, the recording material is discharged from a discharging portion 116 to an outside of an apparatus main assembly. Further, a transfer residual toner remaining on the intermediary transfer belt 106 without being transferred onto the recording material at the secondary-transfer portion is collected by an intermediary transfer member cleaner 108.

Incidentally, in this embodiment, the image bearing members 101*a* (first photosensitive drum), 101*b* (second photosensitive drum), 101*c* (third photosensitive drum) and 101*d* (fourth photosensitive drum) contact the intermediary transfer belt from an outside. The respective photosensitive drums and the intermediary transfer belt form contact portions (primary-transfer portions, primary-transfer nips, first to fourth transfer portions) N1a (first transfer portion), N1b (second transfer portion), N1c (third transfer portion) and N1d (fourth transfer portion). The toner image is transferred from each image bearing member onto the intermediary transfer belt at each contact portion. Further, the respective contact portions are disposed in a straight line in a plane perpendicular to rotation axes of the respective photosensitive drums. Further, in this embodiment, diameters of the respective photosensitive drums are the same, and therefore rotation centers of the respective photosensitive drums are disposed in a straight line in the plane perpendicular to the rotation axes of the respective photosensitive drums. In this way, the respective photosensitive drums are disposed in the straight line, so that it is suppressed that a height of the apparatus becomes high.

[Arrangement of Intermediary Transfer Unit and Supporting Rollers]

In the constitution provided with no primary-transfer roller, there is a liability that a belt surface between the photosensitive drums slacks. However, if a depressing member is disposed with respect to the belt surface between the respective photosensitive drums, a plurality of depressing members are needed, and therefore, there is a liability that the depressing members lead to an increase in cost.

Therefore, only one depressing member for depressing the belt surface between two central photosensitive drums 101*b* and 101*c* is provided. That is, only one depressing member 111*c* for depressing only a region (central region) of the intermediary transfer member between the photosensitive drum 101*b* for magenta and the photosensitive drum 101*c* for cyan is disposed.

Further, in this embodiment, in order to ensure a long contact length, arrangement of the supporting rollers 111*a* and 111*b* is utilized.

Here, a phantom common tangential line between the supporting roller 111*a* and the supporting roller 111*b* in a side where the photosensitive drums are disposed is B. The intermediary transfer belt is disposed so as to be depressed from an outside so that the intermediary transfer belt is disposed toward an inside of this common tangential line B.

Further, with respect to the contact lengths of the central two photosensitive drums 101*b* and 101*c*, the contact lengths are made long by utilizing the depressing member.

By employing such a constitution, the contact lengths of the respective photosensitive drums 101*a*, 101*b*, 101*c* and 101*d* with the intermediary transfer belt can be made long, so that the number of depressing members for elongating the contact lengths can be made one.

Incidentally, the depressing member referred to in this embodiment is disposed so as to be depressed in 5 mm with respect to a phantom surface (plane) of the intermediary transfer belt between the photosensitive drum 101*b* and the photosensitive drum 101*c* in the case where assumption is made that no depressing member exists.

Of course, the present invention is not intended to be limited to this numerical value, but in the case where the photosensitive drum of 30 mm in diameter is disposed, the value may desirably be set at least 2.5 mm or more. It is desirable that the value is set at a proper value depending on the diameter and an interval of the photosensitive drums.

Figure 14:
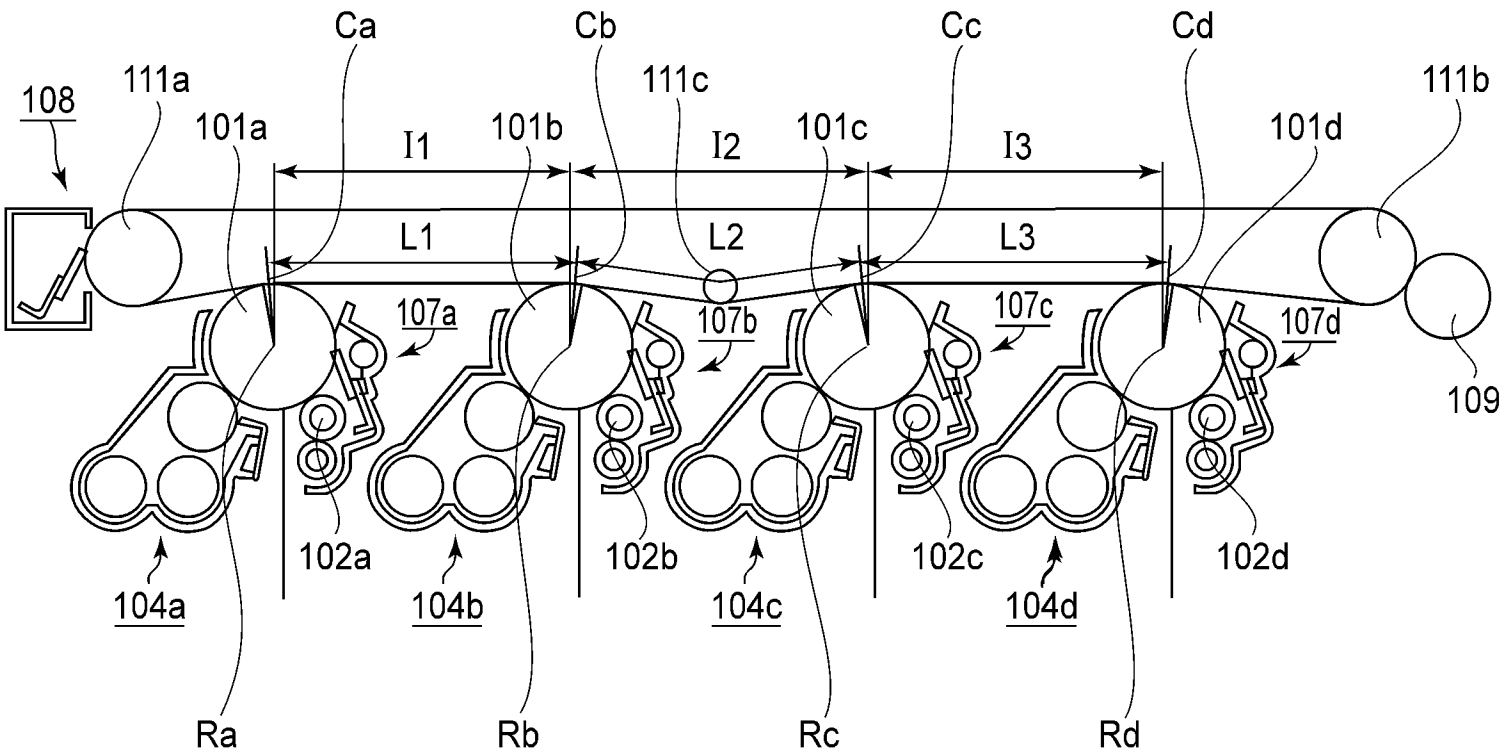
FIG. 14 shows a positional relationship of respective photosensitive drums.

By using FIG. 14, the arrangement of the respective photosensitive drums in this embodiment will be further described.

If a length on the belt from the primary-transfer portion N1a to an adjacent primary-transfer point N1b, a length on the belt from the primary-transfer portion N1b to an adjacent primary-transfer portion N1c, and a length on the belt from the primary-transfer portion N1c to an adjacent primary-transfer portion N1d are different from an integral multiple of a circumference of the driving roller for driving the intermediary transfer belt, there is a liability that speed non-uniformity of the intermediary transfer belt is generated due to eccentricity of the driving roller to cause color misregistration. In order to suppress the color misregistration, it is desirable that an interval on the intermediary transfer belt between the mutually adjacent primary-transfer portions is the integral multiple of the circumference. That is, a relationship such that a distance on the intermediary transfer belt between the central portions of the adjacent photosensitive drums at the transfer portions is established.

In FIG. 14, the central portion at the primary-transfer portion N1a is Ca, the central portion at the primary-transfer portion N1b is Cb, the central portion at the primary-transfer portion N1c is Cc, and the central portion at the primary-transfer portion N1d is Cd. Further, a length between Ca and Cb on the intermediary transfer belt is L1, a length between Cb and Cc on the intermediary transfer belt is L2, and a length between Cb and Cc on the intermediary transfer belt is L3.

That is, in order to suppress the generation of the color misregistration, L1=L2=L3 is satisfied, and in addition, it is desirable that each of the lengths is a length which is the integral multiple of the circumference of the driving roller.

However, in this embodiment, the depressing roller is disposed with respect to the belt surface between the photosensitive drums 101*b* and 101*c* but is not disposed with respect to the belt surface between the photosensitive drums 101*a* and 101*b* and between the photosensitive drums 101*b* and 101*c*.

Here, the supporting roller 111*a* is disposed so as to broaden the primary-transfer portion N1a of the photosensitive drum 101*a* toward an upstream side, and the supporting roller 111*b* is disposed so as to broaden the primary-transfer portion N1d of the photosensitive drum 101*d* toward a downstream side.

For that reason, the central portion at the primary-transfer portion N1a is a central portion at the primary-transfer portion N1a with respect to an intermediary transfer belt movement direction, and therefore the central portion is shifted more toward the upstream side than a rotation center Ra of the photosensitive drum 101*a*. For that reason, L1 is wider than an interval I1 between the rotation center Ra of the photosensitive drum 101*a* and a rotation center Rb of the photosensitive drum 101*b*. Further, Ca is more toward the upstream side than Ra, and Cb is more toward the downstream side than Rb.

Similarly, L3 is wider than an interval I3 between a rotation center Rc of the photosensitive drum 101*c* and a rotation center Rd of the photosensitive drum 101*d*. Further, Cc is more toward the upstream side than Rc, and Cd is more toward the downstream side than Rd.

In this constitution, in order to make L2 equal to L1, a method of increasing the depressing amount of the depressing roller would be considered. However, even when L2 can be made equal to L1 (L3) by increasing the depressing amount of the depressing roller, there is a liability that the belt surface contacts the cleaning device 107*b* and the developing unit 104*c*.

That is, a method in which L2 is made equal to L1 (L3) without increasing the depressing amount of the depressing roller is required.

Therefore, in this embodiment, the distance I2 between the rotation center Rb of the photosensitive drum 101*b* and the rotation center of the photosensitive drum 101*c* is made longer than I1 and I3, whereby L2 is made identical in length to L1 (L3).

FIG. 14 shows a positional relationship among the respective photosensitive drums. I1 is an interval between the rotation center of the photosensitive drum 101*a* and the rotation center of the photosensitive drum 101*b*. I2 is an interval between the rotation center of the photosensitive drum 101*b* and the rotation center of the photosensitive drum 101*c*. I3 is an interval between the rotation center of the photosensitive drum 101*c* and the rotation center of the photosensitive drum 101*d*. As described above, in this embodiment, a relationship of I1=I3<I2 holds.

That is, the distances I1 and I3 each between rotation center positions of the photosensitive drums between which the depressing member 111*c* is not disposed are equal to each other. Further, the interval I2 between the rotation centers of the photosensitive drums between which the depressing member 111*c* is disposed is longer than the intervals I1 and I3 each between the rotation centers of the photosensitive drums between which the depressing member 111*c* is not disposed. Incidentally, the intervals I1 and I3 are 90 mm, and the distance I2 is 93.8 mm.

Further, in this embodiment, in agreement with the circumference of the driving roller, when n is an integer and Lb is the circumference of the driving roller, a relationship of L1=L2=L3=n×Lb is satisfied. That is, L1, L2 and L3 are equal to a length which is an integral multiple of the circumference Lb of the driving roller 111*b*. Incidentally, in this embodiment, a driving roller diameter (outer diameter) is ϕ29.444 mm, the circumference Lb is 46.25 mm and L=92.5, and therefore L=2Lb holds.

Further, a diameter (outer diameter) of the supporting rollers 111*a* and 111*b* is ϕ29.44 mm. Here, a diameter (outer diameter) of the depressing roller is ϕ8 mm. That is, the diameter of the depressing roller is smallest of the rollers supporting the intermediary transfer belt. This reason will be described. The contact length in which the intermediary transfer belt is wound about the depressing roller is small compared with other supporting rollers 111*a* and 111*b*. For that reason, a load exerted on the depressing roller by the intermediary transfer belt is small, and therefore the depressing roller is not readily bent. Therefore, as the depressing roller, a roller smaller in diameter than the supporting rollers 111*a* and 111*b* is used, whereby it is possible to suppress bending of the depressing roller while realizing the cost reduction.

Further, a constitution in which the depressing roller does not depress the intermediary transfer belt surface between the photosensitive drums 101*a* and 101*b* and does not depress the intermediary transfer belt between the photosensitive drums 101*c* and 101*d* is employed. For that reason, the belt surface of the intermediary transfer belt between the photosensitive drums 101*a* and 101*b* is a flat surface, and the belt surface of the intermediary transfer belt between the photosensitive drums 101*c* and 101*d* is a flat surface.

Here, the intermediary transfer unit 100 will be described. The intermediary transfer unit 100 is capable of being inserted into and extracted from an apparatus main assembly along an intermediary transfer unit inserting and extracting rail on the main assembly. The intermediary transfer unit 100 includes an unshown intermediary transfer frame which rotatably supports the supporting rollers 111*a* (first supporting member) and 111*b* (second supporting member) and the depressing member (depressing roller) 111*c*. The supporting roller 111*a* is movable relative to the intermediary transfer frame, and is urged by a spring in a direction of maintaining a tension of the intermediary transfer belt 106. That is, the supporting roller 111*a* functions as the tension roller for imparting the tension to the intermediary transfer belt. The supporting roller 111*b* functions as the driving roller for driving the intermediary transfer belt by an unshown motor (driving source). Further, the supporting roller 111*b* also functions as the inner secondary-transfer roller opposing the outer secondary-transfer roller 109 via the intermediary transfer belt. When the intermediary transfer unit is outside of the apparatus, the intermediary transfer belt 106 is supported by the supporting rollers 111*a* and 111*b*, rotatably relative to the intermediary transfer unit 100.

Further, a cam 801 as a means for moving the position of the intermediary transfer belt is disposed. By rotation of the cam, it is possible to form a contact state (first state) with the four photosensitive drums 101*a*, 101*b*, 101*c* and 101*d*. Further, by the rotation of the cam, it is possible to form a state (second state) in which the intermediary transfer belt is spaced from the photosensitive drums 101*a*, 101*b* and 101*c* and in which the intermediary transfer belt contacts the photosensitive drum 101*d*.

Here, a phantom (flat) plane A is a phantom plane connected by photosensitive drum tangential lines in a side where the photosensitive drums disposed in the straight line on the cross-section (on FIG. 1) contact the intermediary transfer belt. When the intermediary transfer unit is mounted in the apparatus main assembly, the supporting roller 111*a* enters the phantom plane A upstream of the photosensitive drum 101*a*. Further, the supporting roller 111*b* enters the phantom plane A downstream of the photosensitive drum 101*d*. Further, the depressing member enters the phantom plane A between the photosensitive drums 101*b* and 101*c*. As a result, a constitution in which the intermediary transfer belt winds about the respective photosensitive drums is created.

In the case of this embodiment, the diameters of the photosensitive drums 101*a*, 101*b*, 101*c* and 101*d* are 30 mm and thus are the same. Further, the depressing roller 111 is disposed so as to depress a central position in a region between the photosensitive drum 101*b* and the photosensitive drum 101*c*. Further, a constitution in which each of the photosensitive drums enters the intermediary transfer belt by about 5 mm and thus winds about the intermediary transfer belt by about 2.5 mm is created. That is, winding amounts (contact lengths) of the respective photosensitive drums with respect to the intermediary transfer belt are set so as to be identical to each other.

The intermediary transfer belt 106 is set so that a peripheral speed is high relative to the photosensitive drums 101*a*-101*d*, and a frictional force is generated between the intermediary transfer belt 106 and the photosensitive drums 101*a*-101*d*. Here, a tension upstream of the photosensitive drum 101*a* is T0, a tension between the photosensitive drums 101*a* and 101*b* is T1, and a tension between the photosensitive drums 101*b* and 101*c* is T2. Further, a tension between the photosensitive drums 101*b* and 101*c* is T3, and a tension between the photosensitive drums 101*c* and 101*d* is T4. Further, a tension of the intermediary transfer belt downstream of the photosensitive drum 101*d* is T5. A friction coefficient received from each photosensitive drum is μ. Further, an angle at which the intermediary transfer belt 106 winds about the photosensitive drums 101*a*-101*d* is θ. Then, from the known Euler's theory, it can be expressed that $T1=T0e^{\mu\theta}$, $T2=T1e^{\mu\theta}$, $T3=T2e^{\mu\theta}$, $T4=T3e^{\mu\theta}$ and $T5=T4e^{\mu\theta}$. That is, it is understood that $T0<T1<T2<T3<T4<T5$ holds.

This embodiment employs a constitution in which a roller for winding the intermediary transfer belt about the photosensitive drums is provided only between the photosensitive drums 101*b* and 101*c*. In this constitution, the tension exerted on the supporting roller is smaller than a conventional constitution in which the roller for winding the intermediary transfer belt about the photosensitive drums is provided also between the photosensitive drums 101*c* and 101*d*. For this reason, the diameter of the supporting roller for winding the intermediary transfer belt can be made small.

[Color Mode and Monochromatic Mode]

A full-color mode and a monochromatic mode will be described by using FIG. 2 and FIG. 3.

The image forming apparatus in this embodiment is constituted so as to be capable of executing switching between a black single-color mode for forming an image using the photosensitive drum for a black single-color and a color mode for forming images using the photosensitive drums for the respective colors. The black single-color mode and the color mode are executed using a controller 800.

That is, the controller 800 not only performs an operation for forming the images with respect to the respective colors but also controls the cam 801 to carry out the switching between the black single-color mode and the color mode.

Figure 3:
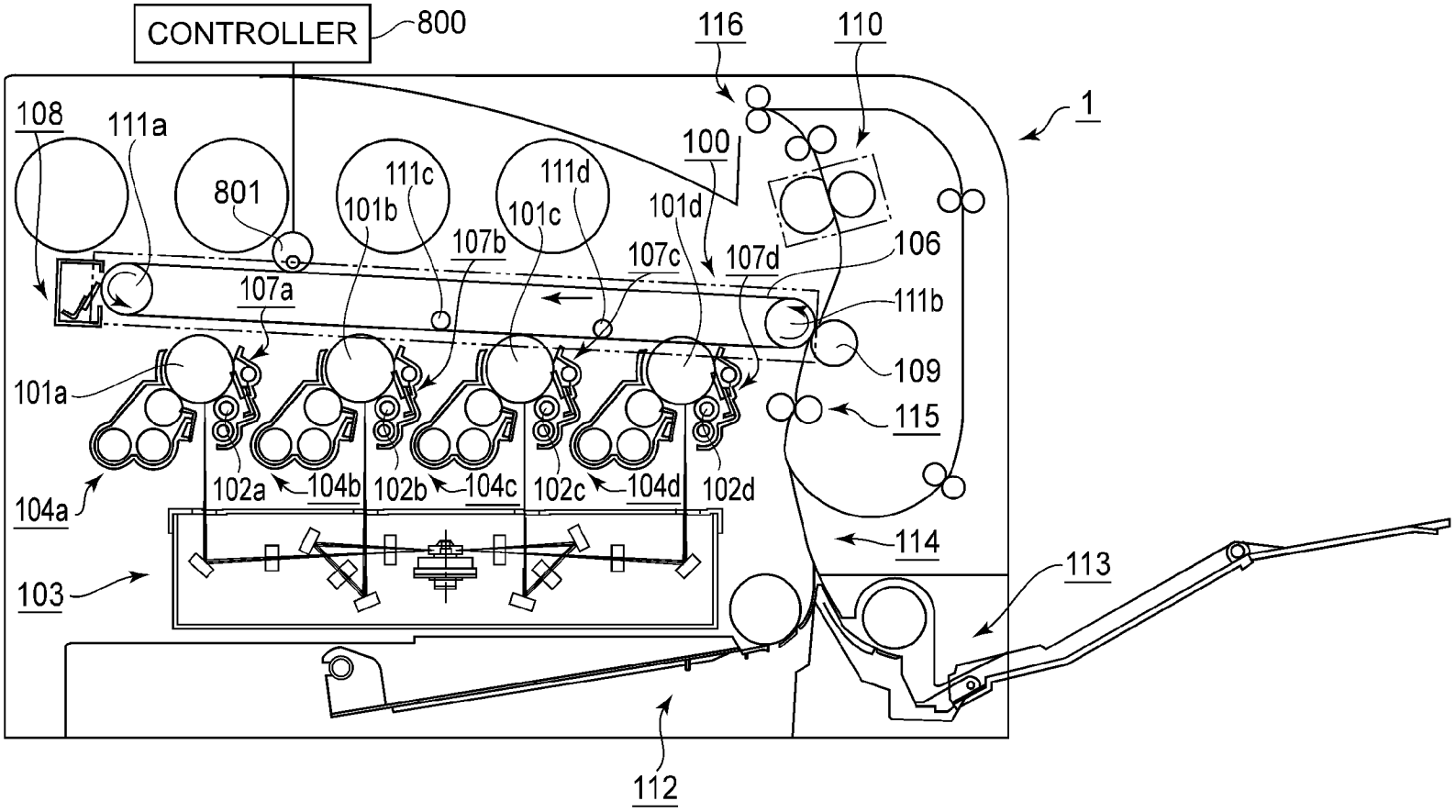
FIG. 3 is a sectional view of the color digital printer in a monochromatic mode in Embodiment 1.

As shown in FIG. 3, in the black single-color mode, the photosensitive drum 101*d* for black and the intermediary transfer belt 106 contact each other to form the primary-transfer portion where the toner image is to be transferred. The photosensitive drums 101*a*, 101*b* and 101*c* for other colors, i.e., yellow, magenta and black, respectively, are in a spaced state from the intermediary transfer belt. That is, the black single-color mode is carried out in the second state. The roller 111*d* is disposed as a contact member, capable of being contacted to and spaced from (contactable and separable relative to) the intermediary transfer belt 106, at a position between the photosensitive drum 101*c* for yellow and the photosensitive drum 101*d* for black with respect to a movement direction of the intermediary transfer belt 106. This reason is because a shape of the primary-transfer portion for black is made flat in the black single-color mode.

Figure 2:
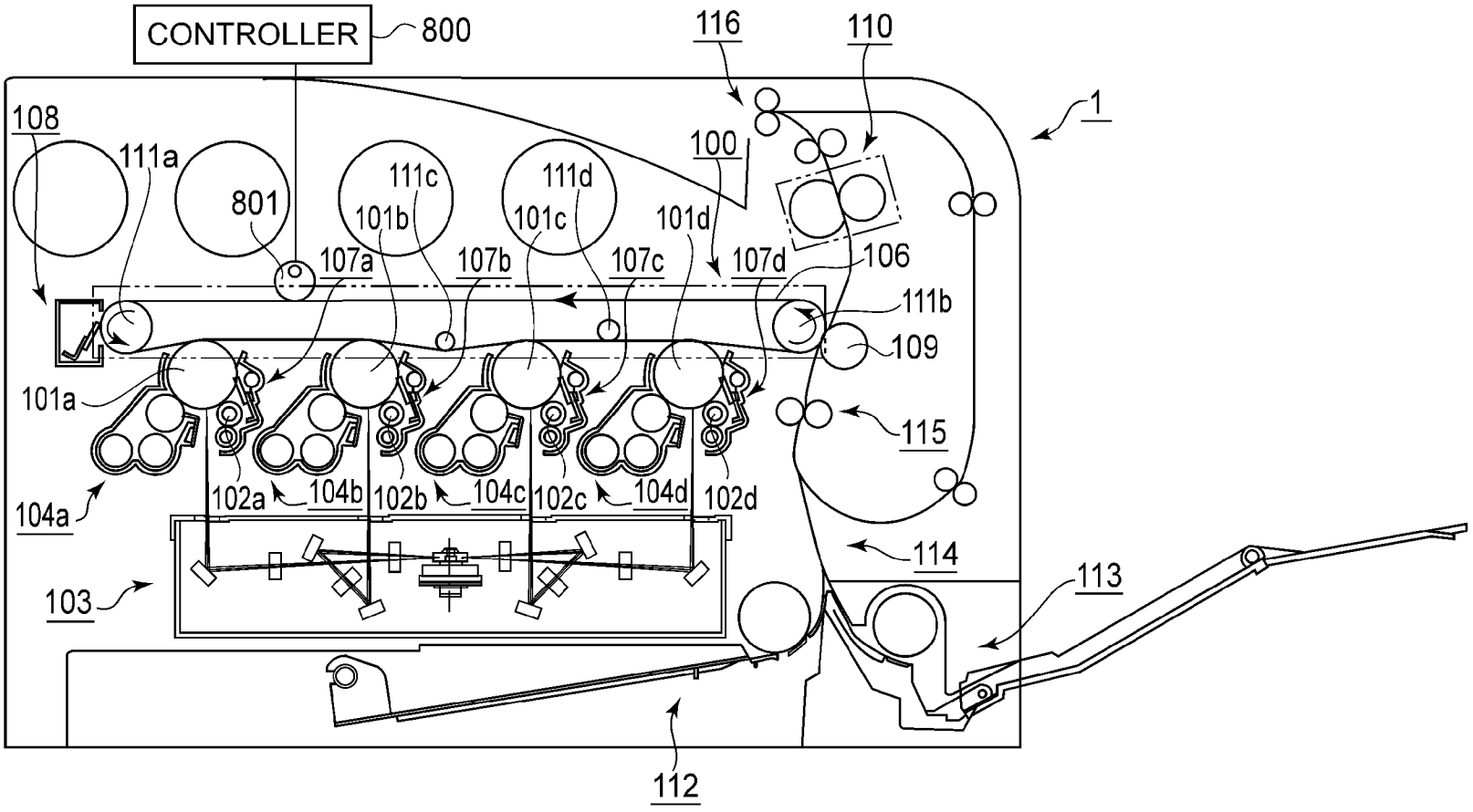
FIG. 2 is a sectional view of the color digital printer in a full-color mode in Embodiment 1.

On the other hand, as shown in FIG. 2, in the color mode, the photosensitive drums 101*a*, 101*b*, 101*c* and 101*d* for yellow, magenta, cyan and black, respectively, are in a contacted state to the intermediary transfer belt (first state). The photosensitive drums 101*a*, 101*b*, 101*c* and 101*d* and the intermediary transfer belt contact each other to form the respective primary-transfer portions. In the color mode, the roller 111*d* is in a mutually spaced state from the intermediary transfer belt. Incidentally, in this embodiment, in the color mode, the roller 111*d* and the intermediary transfer belt are in the mutually spaced state, but the present invention is not intended to be limited to this constitution. It is also possible to employ a constitution in which the roller 111*d* contacts the intermediary transfer belt.

In the case of the full-color mode, as shown in FIG. 2, the supporting roller 111*a* enters the phantom plane A upstream of the photosensitive drum 101*a*. Further, between the photosensitive drums 101*b* and 101*c*, the depressing member enters the phantom plane A. As a result, the intermediary transfer belt 106 winds about the respective photosensitive drums 101*a*-101*d*. At this time, the roller 111*d* contacts the intermediary transfer belt 106 between the photosensitive drums 101*c* and 101*d*, but does not depress the intermediary transfer belt 106 and therefore receives little tension from the intermediary transfer belt 106.

In the case of the monochromatic mode, as shown in FIG. 3, the supporting roller 111*a* and the depressing member 111*c* move in a direction away from the photosensitive drum side. The intermediary transfer belt 106 is spaced relative to the photosensitive drums 101*a*-101*c*, so that the image forming portions using 101*a*-101*c* are capable of being stopped. Further, the intermediary transfer belt 106 is capable of maintaining the winding state about the block photosensitive drum 101*d* by the supporting rollers 111*b* and 111*d*, so that monochromatic printing becomes possible.

[Primary-Transfer High-Voltage-Less System]

The image forming apparatus in this embodiment has a constitution in which a current applied to the secondary-transfer portion by the high-voltage source flows into the respective photosensitive drums via the intermediary transfer belt to perform the action similarly as the conventional primary-transfer portions (hereinafter, referred to as a primary-transfer-high-voltage-less system).

The intermediary transfer unit 100 used in this embodiment will be described. The intermediary transfer belt has a two-layer structure of an inner-surface-side base layer and an outer-surface-side surface layer. As the base layer, a layer in which an anti-static agent such as carbon black is contained in an appropriate amount in a resin (material) such as polyimide or polyamide or in various rubbers is used. The layer is formed so that a volume resistivity thereof is $10^2$-$10^7$ Ω·cm. The layer is constituted by a film-like endless belt of, e.g., about 45-100 μm in thickness thereof. Here, for measurement of the volume resistivity, Hiresta UP MCP-HT450 type manufactured by Mitsubishi Analytech Co., Ltd. was used, and a measuring condition was 10 (V) and 10 (sec). As the resin used, it is possible to use polyphenylene sulfide (PPS), PVdF, nylon, PET, PBT, polycarbonate, PEEK, PEN, and the like. The surface layer is a coat layer which is almost electrically insulative. A thickness thereof is 0.5-10 μm. Further, the intermediary transfer belt including the surface layer is formed so that the volume resistivity with respect to a thickness direction is $10^{10}$-$10^{13}$ Ω·cm. A measuring condition of the volume resistivity with respect to the thickness direction including the surface layer was 100 (V) and 10 (sec). The intermediary transfer belt 106 is circulated and driven (rotationally moved) at a predetermined speed by the various rollers, and a process speed in this embodiment is 135 mm/sec. As the various rollers, the driving roller 111*b* (also functioning as the inner secondary-transfer roller) for circulating and driving the intermediary transfer belt by being driven by a motor excellent in a constant-speed property exists. Further, the tension roller 111*a* functioning as a correction roller for imparting a certain tension to the intermediary transfer belt 106 and for preventing snaking of the intermediary transfer belt 106, and the depressing member 111*c* for being contacted to the intermediary transfer belt 106 from an inside between the second and third stations exist. Incidentally, the belt tension with respect to the tension roller 111*a* is constituted so as to be about 5-12 kgf.

[Surface Potential Adjusting Method of Intermediary Transfer Belt]

In this embodiment, in order to stabilize the primary-transfer, when the voltage is applied, as a potential maintaining means for maintaining a predetermined potential, Zener diode which is a constant-voltage element is used.

Figure 6:
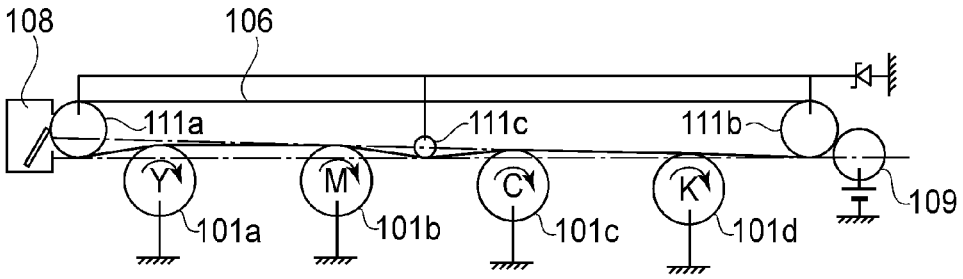
FIG. 6 is a view showing an outline of a cross-section of the color digital printer.

The Zener diode is disposed, in order to keep the intermediary transfer belt potential constant, between the intermediary transfer belt and the ground potential as shown in FIG. 6. In this embodiment, a voltage of the secondary-transfer high-voltage source is set so that when the voltage is applied, the Zener diode maintains 300 V as the predetermined potential.

When the voltage is applied by the secondary-transfer high-voltage source, the potential of the Zener diode maintains the predetermined potential, so that when the voltage is applied between the photosensitive drum and the intermediary transfer belt, a secondary-transfer electric field is formed between the intermediary transfer belt and the outer secondary-transfer roller is formed.

The supporting rollers 111*a* and 111*b* and the depressing member 111*c* for supporting the intermediary transfer belt 106 are constituted by electroconductive members, and each of the rollers is connected to the ground potential via the Zener diode. That is, the Zener diode is connected between each of the supporting rollers 111*a* and 111*b* and the depressing member 111*c*, and the ground potential.

Figure 7:
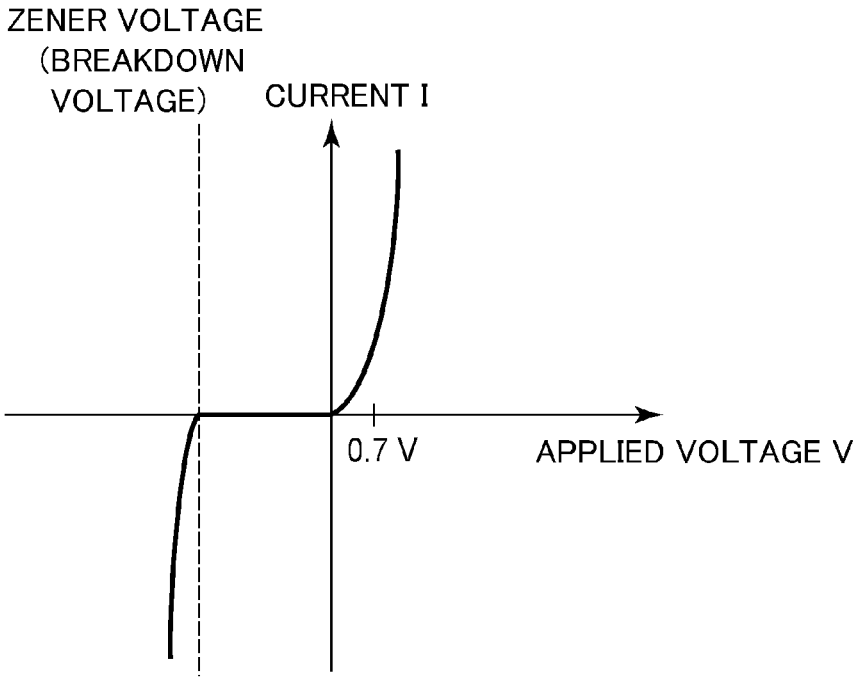
FIG. 7 is an illustration showing an electric characteristic of Zener diode.

FIG. 7 shows an electrical property (VI characteristic) of the Zener diode. The Zener diode has the VI characteristic such that little current passes until a voltage not less than the Zener voltage is applied, but the current abruptly flows when the voltage exceeds the Zener voltage.

In this embodiment, by utilizing the electrical property of this Zener diode, the surface potential of the intermediary transfer belt 106 is constant-controlled at the predetermined potential. That is, the surface potential of the intermediary transfer belt 106 to be intended to be set is used as the Zener voltage, and the secondary-transfer voltage is controlled so that the surface potential of the intermediary transfer belt 106 exceeds the Zener voltage, whereby it becomes possible to always keep the intermediary transfer belt surface potential constant.

In this embodiment, a plurality of Zener diodes each having the Zener voltage of 25 V are connected in series, so that the surface potential of the intermediary transfer belt 106 was set at 300 V. Incidentally, it is preferable that the surface potential of the intermediary transfer belt 106 is different depending on the type of the toner, a combination of materials for the photosensitive drums and the intermediary transfer belt, and the like, and is set at about 200 V-600 V.

Further, the current applied to the outer secondary-transfer roller 109 by the secondary-transfer high-voltage source can flow in a direction of the respective photosensitive drums 101*a*-101*d* via the intermediary transfer belt 106. As a result, a primary-transfer electric field similar to the conventional primary-transfer portions is formed, so that transfer of the toner from the photosensitive drums 101*a*-101*d* onto the intermediary transfer belt 106 can be effectively performed.

Incidentally, in this embodiment, each of the supporting rollers 111*a* and 111*b* and the depressing member 111*c* is connected to the ground potential via the Zener diode, but in place of the Zener diode, similarly a varister, which is a constant-voltage element, may also be used. Further, it is also possible to utilize a resistance element of $10^8$ (Ω) or more.

[Adjusting Method of Primary-Transfer Contrast]

Figure 8:
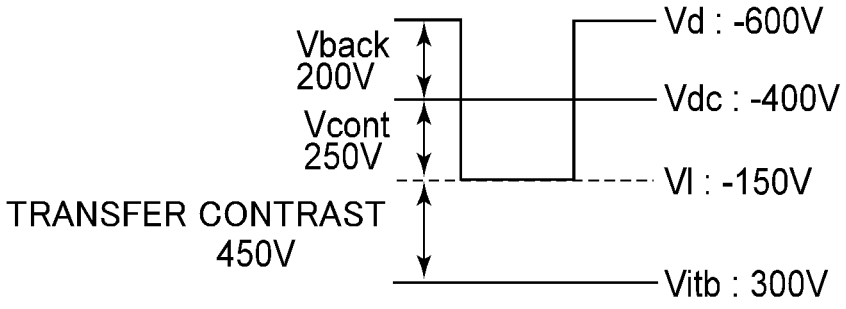
FIG. 8 is an illustration regarding an adjusting method of a transfer contrast.
Figure 8:
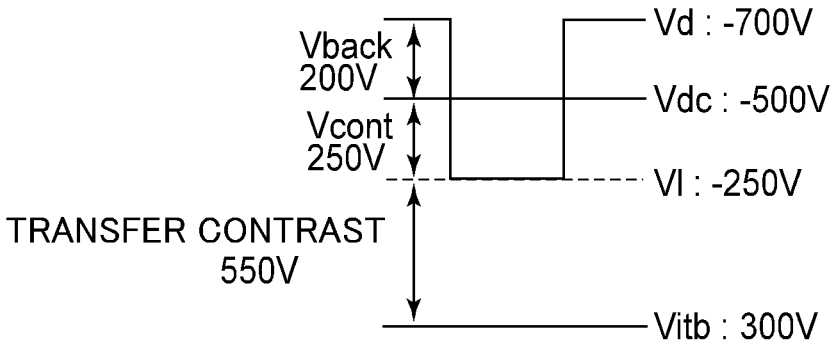

Next, an adjusting method of a primary-transfer contrast will be described. (a) of FIG. 8 is an illustration showing a relationship between the surface potential of the photosensitive drums 101*a*-101*d* and the intermediary transfer belt 106 in this embodiment. In this embodiment, the surface potential of the photosensitive drums 101*a*-101*d* is charged to −600 V. This is a dark-portion potential Vd. Thereafter, image forming portions of the uniformly charged photosensitive drums 101*a*-101*d* are exposed to light by an exposure means, so that the surface potential of the photosensitive drums 101*a*-101*d* is changed to a light-portion potential Vl. Here, the light-portion potential Vl is −150 V.

With respect to this surface potential on the photosensitive drums 101*a*-101*d*, a developing bias Vdc (DC component of a developing high-voltage) is applied by the developing devices 104*a*-104*d*. A negatively charged toner is used for development on the photosensitive drums 101*a*-101*d* by a developing contrast which is a difference between the developing bias Vdc and the photosensitive drum Vl. Here, Vdc is −400 V, and thus the developing contrast Vcont is 250 V.

Further, the surface potential Vitb of the intermediary transfer belt 106 can be set at a desired value by selecting the Zener diode having a desired property in advance. When the Zener voltage is set at 300 V, the primary-transfer contrast is 450 V from a difference between Vitb and Vl.

In this embodiment, in the case where the primary-transfer contrast is adjusted, as shown in (b) of FIG. 8, the primary-transfer contrast is adjusted by changing the surface potentials Vd and Vl of the photosensitive drums 101*a*-101*d*, not the surface potential Vitb of the intermediary transfer belt 106. However, in the case where the developing bias Vdc is changed, control such that Vd, Vdc and Vl are offset toward a negative side while fixing the developing contrast Vcont and Vback is carried out.

Figures 9, 10:
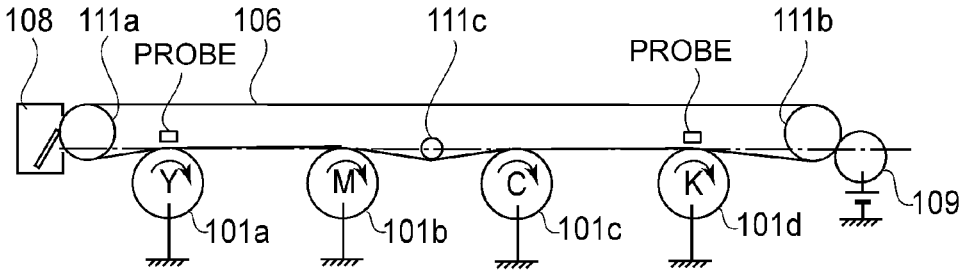
FIG. 9 is an environment table of the transfer contrast.
FIG. 10 is an illustration regarding a belt potential measuring method of an intermediary transfer belt.

FIG. 9 is an environment table of transfer contrasts with respect to the respective colors of Y, M, C and Bk. In this way, the environment table of the primary-transfer contrast is provided every color, and control in which the environment table is switched by each environment (water content) is effected, so that it is possible to obtain a necessary primary-transfer contrast every environment and every color.

Further, with respect to a durability change, by effecting control in which the environment table of the primary-transfer contrast is switched depending on a durability print number, it is possible to obtain the necessary primary-transfer contrast even with respect to the durability change.

[Belt Potential in Intermediary Transfer Unit]

Figure 11:
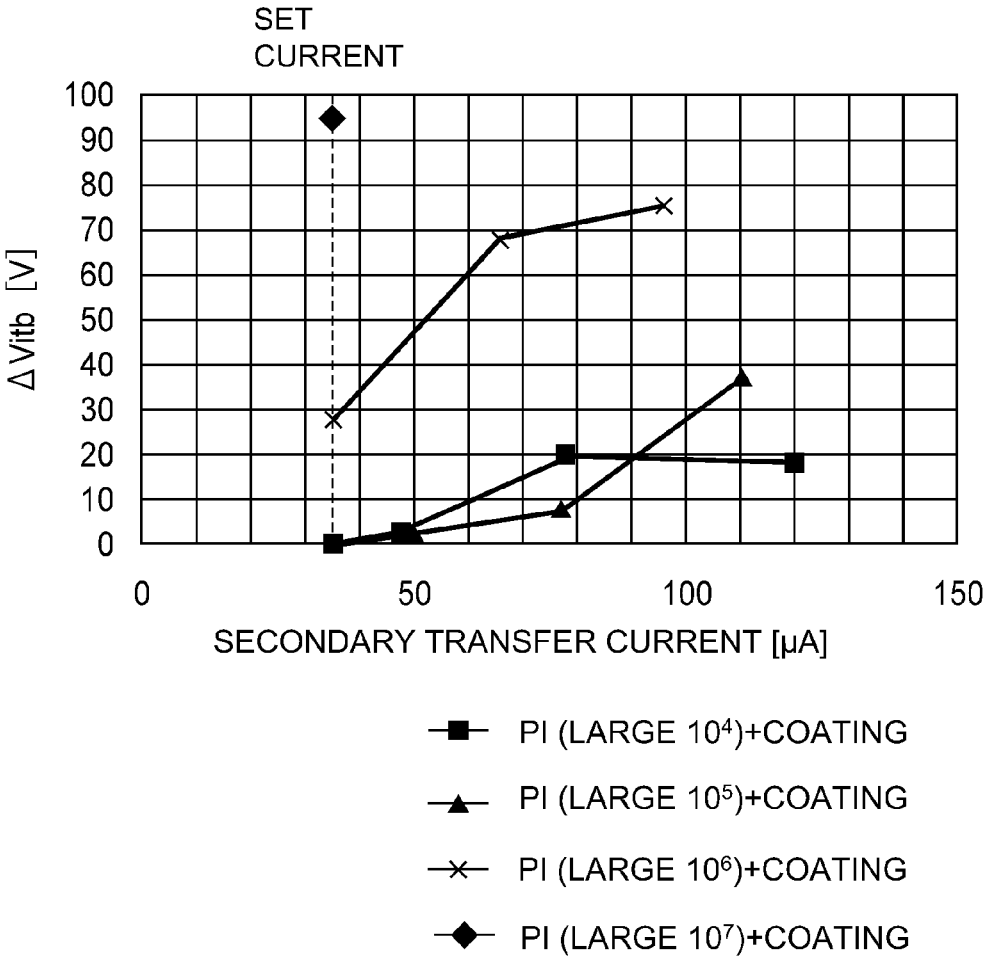
FIG. 11 is an illustration showing a relationship between a belt potential difference ΔVitb and a secondary-transfer current.

Next, the belt potential in the intermediary transfer unit will be described. FIG. 10 is an illustration showing a measuring method of the belt potential with respect to a circumferential direction in the intermediary transfer unit 100. Further, in FIG. 11, ΔVitb shows a difference between the intermediary transfer belt potential at the primary-transfer portion for Y color in the upstreammost side and the intermediary transfer belt potential at the primary-transfer portion for K color in the downstreammost side. That is, FIG. 11 is a diagram showing a relationship between ΔVitb and the secondary-transfer current. In this embodiment, as shown in FIG. 10, in a state in which the supporting rollers 111*a* and 111*b* and the depressing member 111*c* were placed in a flat state, probes of a surface electrometer were disposed at the primary-transfer portions of the first station and the fourth station, and then the belt potential was measured. Incidentally, as the surface electrometer, Model 344 manufactured by Torec Japan K.K. was used.

As shown in FIG. 11, there is a tendency that ΔVitb becomes large with an increasing secondary-transfer current. This reason is because when the flowing current becomes large, a voltage drop at the intermediary transfer belt between the upstreammost-side photosensitive drum 101*a* and the downstreammost-side photosensitive drum 101*d* becomes large. Further, there is a tendency that ΔVitb becomes large with an increasing volume resistivity of the base layer. This reason is because when the volume resistivity of the base layer becomes large, a voltage drop at the base layer of the intermediary transfer belt between the upstreammost-side photosensitive drum 101*a* and the downstreammost-side photosensitive drum 101*d* becomes large.

In the case where the resistance of the base layer is large, there is a liability that a gradient is generated in the belt potential. As a result, even when setting of the dark-portion potential of the photosensitive drum is the same with respect to the photosensitive drums for the respective colors, there is a liability that the current contributing to the primary-transfer is not the same with respect to the photosensitive drums for the respective colors.

Therefore, in the primary-transfer-high-voltage-less system, an upper limit volume of the volume resistivity of the intermediary transfer belt is determined so as to suppress the generation of the gradient in the intermediary transfer belt potential.

In the case where the secondary-transfer current is a set current (set current: 35.0 (μA)), the volume resistivity upper-limit volume of the base layer of the intermediary transfer belt 106 is determined so that the intermediary transfer belt potential is the almost same potential (ΔVitb several 10 (V)) in a region from the upstreammost-side primary-transfer portion to the downstreammost-side primary-transfer portion.

As a result, in the case where the dark-portion potential Vd of the photosensitive drums 101*a*-101*d* was set at the same value with respect to the photosensitive drums for the respective colors, it was checked that the values of the currents flowing into the respective photosensitive drums were almost equal to each other.

Embodiment 2

Overlapping points with Embodiment 1 will be omitted from description. A different point from Embodiment 1 will be described. In Embodiment 1, the contact length between the photosensitive drum and the intermediary transfer belt is the same with respect to the photosensitive drums 101*a-d*. On the other hand, in Embodiment 2, the contact length is different depending on the photosensitive drums.

[Relationship Between Contact Length and Transfer Efficiency]

Figure 12:
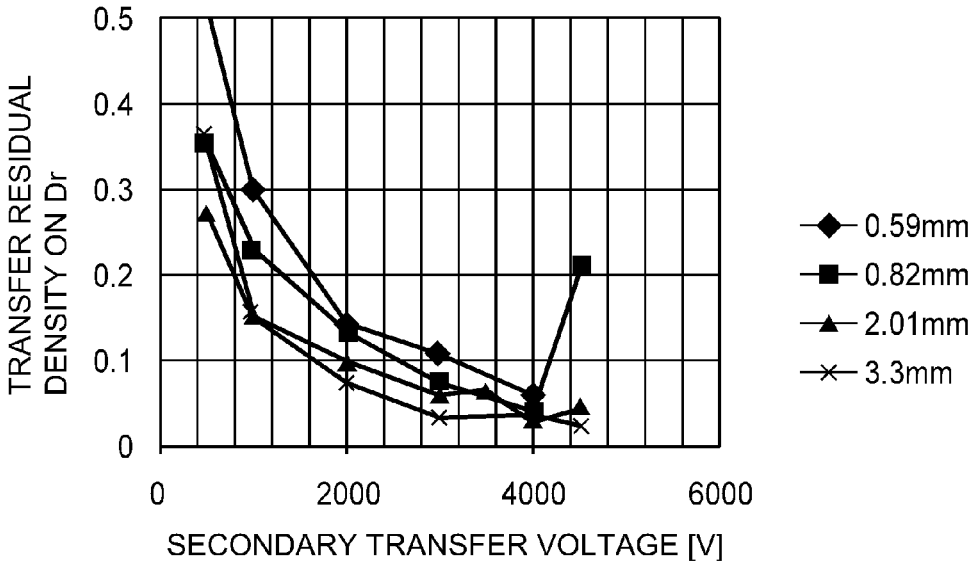
FIG. 12 is an illustration showing a relationship between a contact length of the intermediary transfer belt with a photosensitive drum and a transfer efficiency.

Subsequently, a relationship between the contact length of the intermediary transfer belt 106 with the photosensitive drums 101*a*-101*d*, and the transfer efficiency will be described. FIG. 12 is an illustration of a relationship between the contact length of the intermediary transfer belt 106 with the photosensitive drums 101*a*-101*d*, and the transfer efficiency on the photosensitive drums 101*a*-101*d*. Further, in measurement of transfer residual (toner) density on the photosensitive drums 101*a*-101*d*, X-rite spectrometer was used. As shown in FIG. 12, it was confirmed that with an increasing contact length of the intermediary transfer belt, rising of the transfer efficiency became early and a maximum transfer efficiency was improved.

[Intermediary Transfer Unit in this Embodiment]

FIG. 6 is an illustration regarding a cross-sectional structure of the intermediary transfer unit 100 in this embodiment. As described above, in the primary-transfer-high-voltage-less system, in order to suppress the potential gradient of the intermediary transfer belt, the volume resistivity upper-limit value of the base layer of the intermediary transfer belt 106 was determined. However, the volume resistivity of the base layer of the intermediary transfer belt 106 includes an unavoidable variation in manufacturing. As a result, there is a liability that a potential difference between the upstream-most-side primary-transfer portion and the downstreammost-side primary-transfer portion in a current path of the intermediary transfer belt is excessively large, and thus the transfer efficiency of any of the primary-transfer portions is less than a target value.

Here, the current path is a path such that the current flows from the secondary-transfer high-voltage source to the respective photosensitive drums 101*a*-101*d* via the outer secondary-transfer roller 109, the contact portion of the intermediary transfer belt 106 with the outer secondary-transfer roller 109 and the contact portion of the intermediary transfer belt 106 with the supporting roller 111*b* and further via the intermediary transfer belt 106.

The upstream side refers to the secondary-transfer high-voltage source side, and the downstream side refers to the photosensitive drum side.

Further, the supporting roller 111*b* is an equipotential member connected to the Zener diode in one side together with another supporting roller 111*a* and the depressing member 111*c*.

Therefore, the photosensitive drum for which a shortest distance, passing through the transfer belt 106, from the supporting roller 111*a*, the supporting roller 111*b* and the depressing member 111*c* to the primary-transfer portion is shortest is positioned in the upstreammost side, and the photosensitive drum for which the shortest distance is longest is positioned in the downstreammost side.

Figure 13:
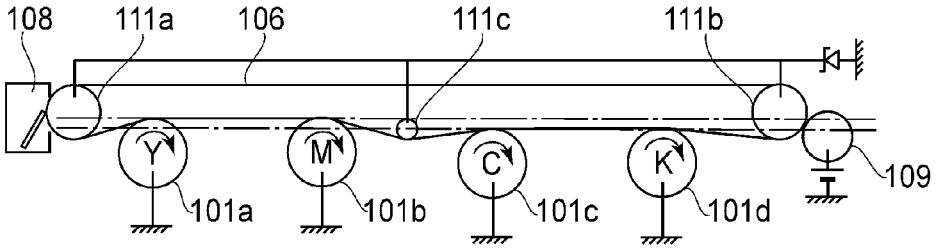
FIG. 13 is a sectional view of an intermediary transfer unit in Embodiment 2.

Therefore, in this embodiment, with the aim of ensuring a transfer property at the photosensitive drum provided in a downstream side in the current path even in the case where ΔVitb is out of specification, it is desirable that the constitution as shown below is employed. That is, with respect to a direction in which the recording material is conveyed, with position of the photosensitive drum in a more downstream side in the current path, it is desirable that the contact length between the photosensitive drum and the intermediary transfer belt 106 becomes large. In order to provide such a contact length, an entering amount of each of the photosensitive drums 101*a*-101*d* with respect to the intermediary transfer belt 106, and an entering amount of the depressing member 111*c* with respect to the intermediary transfer belt 106 are set. In this embodiment, with the position of the photosensitive drum in a more downstream side in the current path, setting is made so that the contact length between the photosensitive drum and the intermediary transfer belt 106 is increased. But, of course, the present invention is not intended to be limited to this constitution. It is also possible to employ a constitution as shown in FIG. 13.

By employing a cross-sectional structure of the intermediary transfer unit as described above, cost reduction and downsizing of the apparatus become possible, and it becomes possible that the transfer property of the primary-transfer portion is ensured.

Incidentally, in this embodiment, the supporting rollers are disposed so that the photosensitive drum contact length becomes larger with the photosensitive drum disposed in a more downstream side in the current path with respect to the direction in which the recording material is conveyed. Further, a constitution in which the depressing roller 111 is disposed at a central portion in a region between the photosensitive drums 101*b* and 101*c* is employed. However, the present invention is not intended to be limited to this constitution.

Embodiment 3

Overlapping points with Embodiment 1 will be omitted from description. A different point from Embodiment 1 will be described. In Embodiment 1, the primary-transfer surfaces formed by the primary-transfer portions of the intermediary transfer belt are disposed along the horizontal surface, but in Embodiment 3, the primary-transfer surfaces formed by the primary-transfer portions of the intermediary transfer belt are disposed by being obliquely inclined with respect to the horizontal surface.

Figure 4:
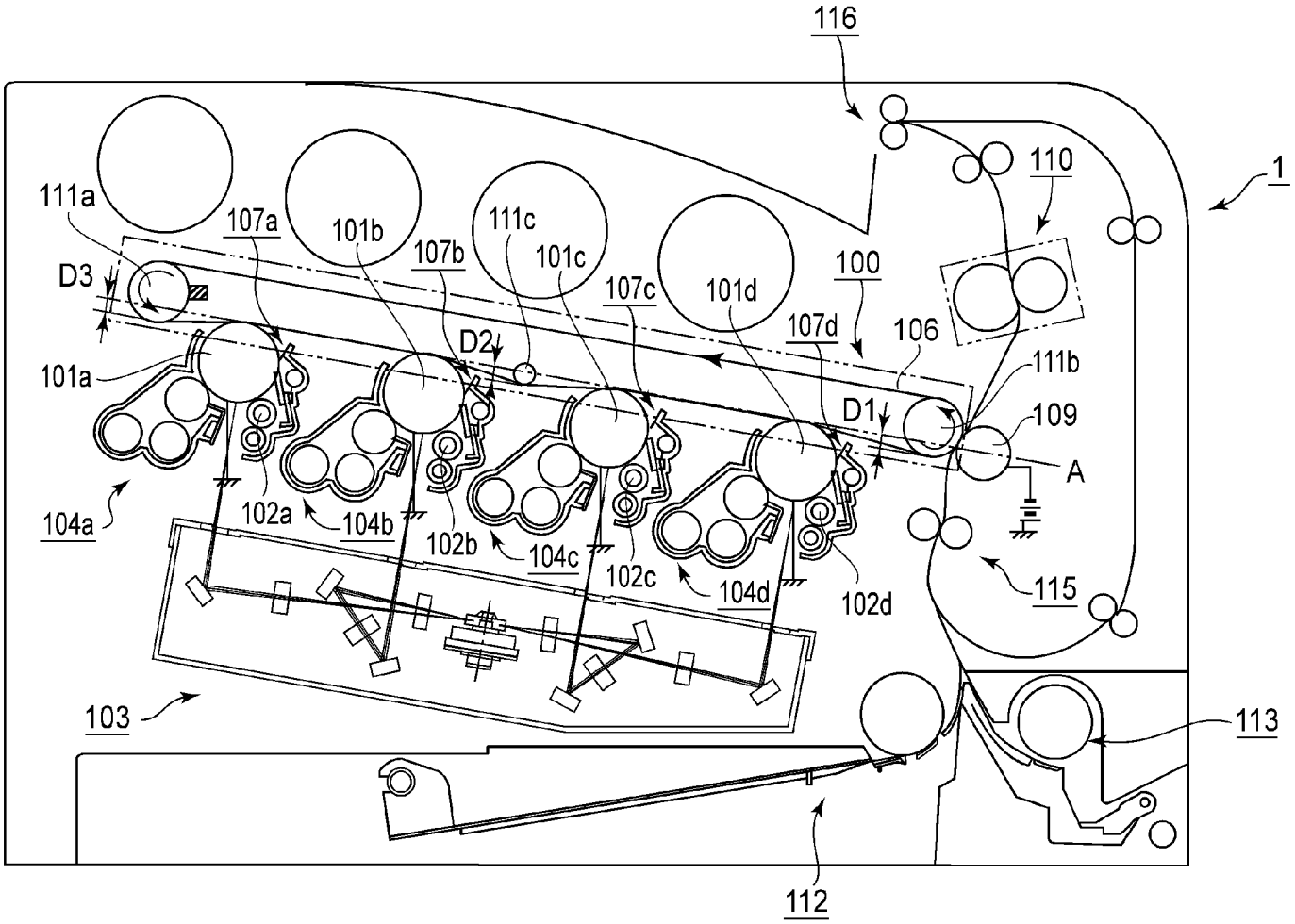
FIG. 4 is a sectional view of a color digital printer in Embodiment 3.

FIGS. 4 and 6 are schematic illustrations showing a color digital printer as an example of an image forming apparatus (tandem type full-color image forming apparatus of an electrophotographic type in this embodiment) according to Embodiment 3.

An outline of the image formation is similar to that described in Embodiment 1, and therefore will be omitted.

The intermediary transfer unit 100 will be described. The intermediary transfer unit 100 includes an unshown intermediary transfer frame for rotatably supporting the supporting rollers 111*a* and 111*b* and the depressing member 111*c*.

In FIG. 4, an entering (or projecting) amount D3 is an entering amount of the supporting roller 111*a* in the photosensitive drum direction with respect to the plane A of the photosensitive drums 101*a*-101*d* in the intermediary transfer belt side. An entering amount D1 is an entering amount of the supporting roller 111*b* in the photosensitive drum direction with respect to the plane A of the photosensitive drums 101*a*-101*d* in the intermediary transfer belt side. An entering amount D2 is an entering amount of the depressing member 111*c* in the photosensitive drum direction with respect to the plane A of the photosensitive drums 101*a*-101*d* in the intermediary transfer belt side.

Figure 5:
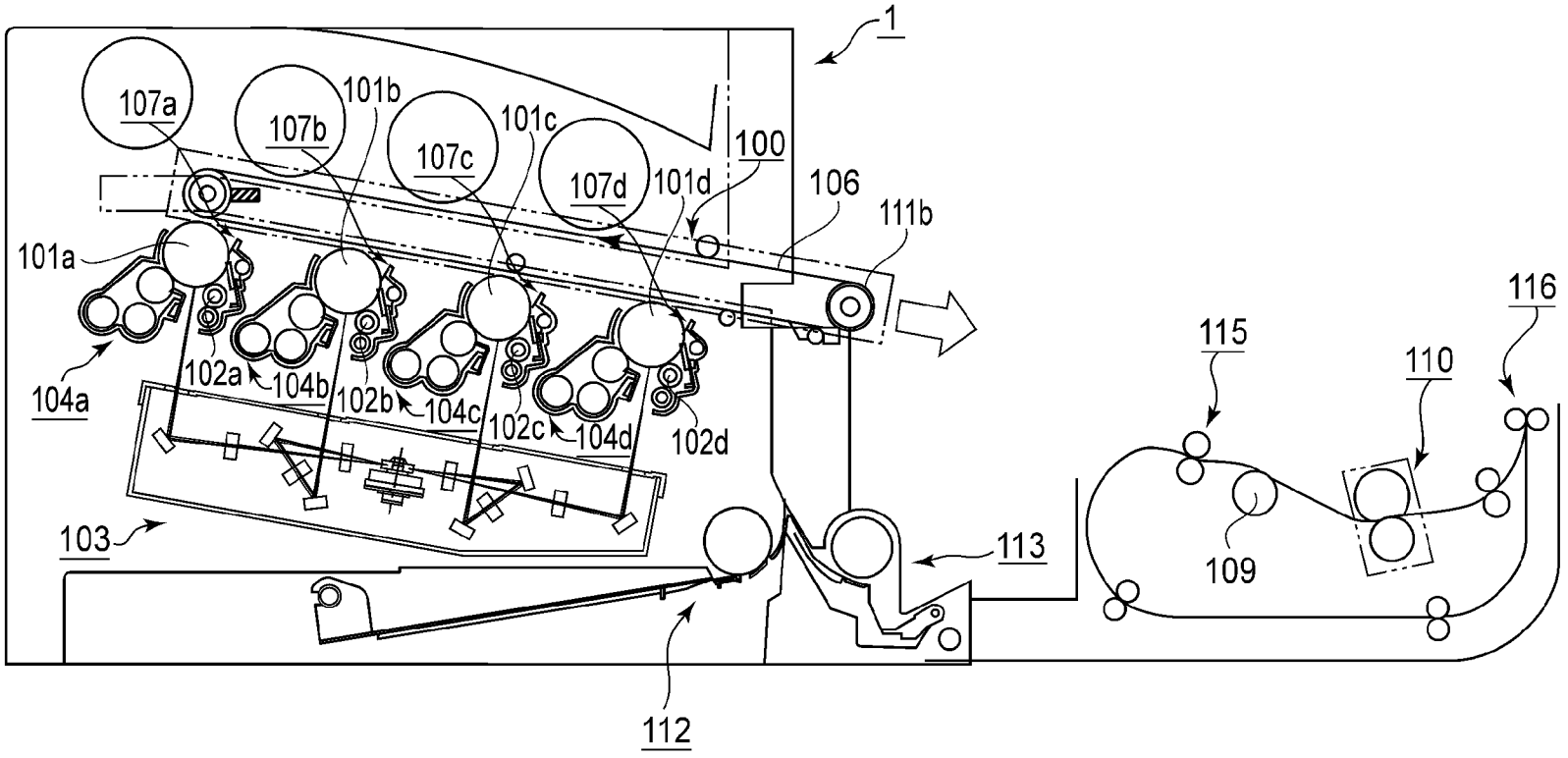
FIG. 5 is a sectional view of the color digital printer in Embodiment 3.

In this embodiment, from reliability of positioning of the image forming portions for the respective colors, a constitution in which the supporting roller 111*b* side of the intermediary transfer unit 100 is exposed by rotationally moving a conveying portion as shown in FIG. 5, and then the intermediary transfer unit 100 is pulled out toward the supporting roller 111*b* side is employed.

As described above, in the case where the intermediary transfer unit 100 is pulled out toward the right side in the figure, it is desirable that the supporting rollers 111*a* and 111*b* are prevented from contacting the photosensitive drums. For that purpose, it is effective that the intermediary transfer unit 100 is moved in a direction away from the photosensitive drums and then is pulled out toward the right side in the figure. The entering amount D2 of the depressing member 111*c* is determined by the contact length between the intermediary transfer belt 106 and each of the photosensitive drums 101*a*-101*d* and a patch between the photosensitive drums, and constitutes a minimum condition for moving the intermediary transfer unit 100 by D2 in the direction away from the photosensitive drums. In the case where the entering amount D1 of the supporting roller 111*a* is larger than D2, the intermediary transfer unit 100 has to be moved by D1 in the direction away from the drum, and therefore by making setting of D1≤D2, the intermediary transfer unit can be inserted and extracted in a minimum movement amount D2. Further, a sensor (not shown) for adjusting a print position between the photosensitive drums and a density is disposed between the downstreammost-side photosensitive drum 101*d* and the secondary-transfer roller 109, and therefore D3 becomes large, but there is no problem since there is no contact with the photosensitive drums when the intermediary transfer unit 100 is pulled out.

Therefore, in order to pull out the intermediary transfer unit 100 toward the supporting roller 111*b* side, for minimizing the movement distance of the intermediary transfer unit 100 in the direction away from the photosensitive drums, there is a need to satisfy:

$$D1 \leq D2 \quad \text{(formula 1).}$$

Incidentally, in this embodiment, the depressing roller is disposed on only the belt surface between the photosensitive drums 101*b* and 101*c*, but in Embodiment 4, it is also possible to employ a constitution in which the depressing roller is disposed on also the belt surface between other photosensitive drums.

INDUSTRIAL APPLICABILITY

By the present invention, it becomes possible to suppress the height of the apparatus while ensuring the contact length in which each of the photosensitive drums contacts the intermediary transfer belt.

The invention claimed is:

1. An image forming apparatus comprising:

a movable endless intermediary transfer belt;

a plurality of supporting rollers, including a first supporting roller and a second supporting roller, configured to support said intermediary transfer belt;

first to fourth photosensitive drums which are arranged along said intermediary transfer belt between the first supporting roller and the second supporting roller in the order of said first photosensitive drum, said second photosensitive drum, said third photosensitive drum and said fourth photosensitive drum from an upstream side toward a downstream side with respect to a direction in which said intermediary transfer belt moves, and which contact said intermediary transfer belt, wherein toner images transferred from said first, second, third and fourth photosensitive drums onto said intermediary transfer belt at first, second, third and fourth primary-transfer portions, respectively, are transferred from said intermediary transfer belt onto a recording material at a secondary-transfer portion, and wherein the first to fourth primary-transfer portions are disposed in a phantom region demarcated by an assumed position of said intermediary transfer belt stretched by the first supporting roller and the second supporting roller in a hypothetical case wherein said first to fourth photosensitive drums are not provided;

a constant voltage element which is electrically connected between said intermediary transfer belt and a ground potential and which maintains a predetermined voltage by passing of a current therethrough;

a voltage source configured to apply a voltage to a transfer member for transferring a toner image from said intermediary transfer belt onto the recording material to pass a current through said constant-voltage element thereby to form a secondary-transfer electric field at the secondary-transfer portion and a primary-transfer electric field at the first to fourth primary-transfer portions; and a depressing member, provided in contact with an inner peripheral surface of said intermediary transfer belt between the second primary-transfer portion and the third primary-transfer portion, configured to depress said intermediary transfer belt from the inner peripheral surface toward an outer peripheral surface of said intermediary transfer belt.

2. An image forming apparatus according to claim 1, wherein said first to fourth photosensitive drums have the same diameter, and rotational axes of said first to fourth photosensitive drums are disposed in a straight line in a plane perpendicular to the rotational axes of said photosensitive drums.

3. An image forming apparatus according to claim 1, wherein a length of a belt surface of said intermediary transfer belt each of between the first primary-transfer portion and the second primary-transfer portion, between the second primary-transfer portion and the third primary-transfer portion, and between the third primary-transfer portion and the fourth primary-transfer portion is an integral multiple of a circumference of a driving roller, included in said plurality of supporting rollers, configured to drive said intermediary transfer belt.

4. An image forming apparatus according to claim 3, wherein the length of the belt surface between the primary-transfer portions is a length, with respect to a movement direction of said intermediary transfer belt, between a central portion of a contact length which is a length in which said intermediary transfer belt and one of said photosensitive drums are in contact with each other at one of the primary-transfer portions and a central portion of the contact length at the primary-transfer portion adjacent to the one of the primary-transfer portions.

5. An image forming apparatus according to claim 1, wherein a distance between a rotational axis of said second photosensitive drum and a rotational axis of said third photosensitive drum is longer than a distance between a rotational axis of said first photosensitive drum and a rotational axis of said second photosensitive drum and a distance between the rotational axis of said third photosensitive drum and a rotational axis of said fourth photosensitive drum.

6. An image forming apparatus according to claim 1, wherein said depressing member is a roller, and has a diameter smaller than a minimum diameter of said plurality of supporting rollers.

7. An image forming apparatus according to claim 1, wherein the first to fourth primary-transfer portions provide the same contact length.

8. An image forming apparatus according to claim 1, wherein said intermediary transfer belt is set to have a peripheral speed higher than that of said first to fourth photosensitive drums.

9. An image forming apparatus according to claim 1, further comprising:

a controller capable of switching between a first state in which said first to fourth photosensitive drums are contacted to said intermediary transfer belt and a second state in which only said fourth photosensitive drum is contacted to said intermediary transfer belt and in which said first to third photosensitive drums are spaced from said intermediary transfer belt; and a contact member capable of being contacted to and spaced from said intermediary transfer belt between said third photosensitive drum and said fourth photosensitive drum, wherein said controller moves, in the second state, said contact member to a position where said contact member contacts said intermediary transfer belt to form a predetermined contact length at the fourth primary-transfer portion.

10. An image forming apparatus according to claim 1, wherein the first supporting roller, the second supporting roller and said depressing member are constituted by members having electroconductivity, and are connected to a ground potential via said constant-voltage element.

11. An image forming apparatus comprising:

a movable endless intermediary transfer belt;

a plurality of supporting rollers, including a first supporting roller and a second supporting roller, configured to support said intermediary transfer belt;

first to fourth photosensitive drums which are arranged along said intermediary transfer belt between the first supporting roller and the second supporting roller in the order of said first photosensitive drum, said second photosensitive drum, said third photosensitive drum and said fourth photosensitive drum from an upstream side toward a downstream side with respect to a direction in which said intermediary transfer belt moves, and which contact said intermediary transfer belt, wherein toner images transferred from said first, second, third and fourth photosensitive drums onto said intermediary transfer belt at first, second, third and fourth primary-transfer portions, respectively, are transferred from said intermediary transfer belt onto a recording material at a secondary-transfer portion, and wherein when said first to fourth photosensitive drums are viewed from a direction along rotational axes of said photosensitive drums, a part of each of said first to fourth photosensitive drums is disposed at a position where the part crosses a common tangential line, of two common tangential lines of the first supporting roller and the second supporting roller, closer to the rotational axes of said photosensitive drums;

a constant voltage element which is electrically connected between said intermediary transfer belt and a ground potential and which maintains a predetermined voltage by passing of a current therethrough;

a voltage source configured to apply a voltage to a transfer member for transferring a toner image from said intermediary transfer belt onto the recording material to pass a current through said constant voltage element thereby to form a secondary-transfer electric field at the secondary-transfer portion and a primary-transfer electric field at the first to fourth primary-transfer portions; and a depressing member, provided in contact with an inner peripheral surface of said intermediary transfer belt between the second primary-transfer portion and the third primary transfer portion and disposed at a position where said depressing member crosses a common tangential line, of two common tangential lines of said second photosensitive drum and said third photosensitive drum, positioned on a side where said second photosensitive drum and said third photosensitive drum contact said intermediary transfer belt when said second and third photosensitive drums are viewed from a direction along the rotational axes of said photosensitive drums, said depressing member being configured to depress said intermediary transfer belt from the inner peripheral surface toward an outer peripheral surface of said intermediary transfer belt.

12. An image forming apparatus according to claim 11, wherein the first supporting roller is a roller, of the plurality of supporting rollers, closest to and upstream of the first primary-transfer portion with respect to the movement direction of said intermediary transfer belt, and the second supporting roller is a roller, of the plurality of supporting rollers, closest to and downstream of the fourth primary-transfer portion with respect to the movement direction of said intermediary transfer belt.

13. An image forming apparatus according to claim 11, wherein said first to fourth photosensitive drums have the same diameter, and when said first to fourth photosensitive drums are viewed from the direction along the rotational axes of said photosensitive drums, the rotational axes of said first to fourth photosensitive drums are disposed in a straight line.

14. An image forming apparatus comprising:

a movable endless intermediary transfer belt;

a plurality of supporting rollers, including a first supporting roller and a second supporting roller, configured to support said intermediary transfer belt;

first and second photosensitive drums which are arranged along said intermediary transfer belt between the first supporting roller and the second supporting roller, and which contact said intermediary transfer belt, wherein toner images transferred from said first and second photosensitive drums onto said intermediary transfer belt at first and second primary-transfer portions, respectively, are transferred from said intermediary transfer belt onto a recording material at a secondary-transfer portion, and wherein when said first and second photosensitive drums are viewed from a direction along rotational axes of said photosensitive drums, a part of each of said first and second photosensitive drums is disposed at a position where the part crosses a common tangential line, of two common tangential lines of the first supporting roller and the second supporting roller, closer to the rotational axes of said photosensitive drums;

a constant voltage element which is electrically connected between said intermediary transfer belt and a ground potential and which maintains a predetermined voltage by passing of a current therethrough;

a voltage source configured to apply a voltage to a transfer member for transferring a toner image from said intermediary transfer belt onto the recording material to pass a current through said constant voltage element thereby to form a secondary-transfer electric field at the secondary-transfer portion and a primary-transfer electric field at the first and second primary-transfer portions; and a depressing member, provided in contact with an inner peripheral surface of said intermediary transfer belt between the first primary-transfer portion and the second primary transfer portion, and disposed at a position where said depressing member crosses a common tangential line, of two common tangential lines of said first photosensitive drum and said second photosensitive drum, positioned on a side where said first photosensitive drum and said second photosensitive drum contact said intermediary transfer belt when said first and second photosensitive drums are viewed from a direction along the rotational axes of said photosensitive drums, said depressing member being configured to depress said intermediary transfer belt from the inner peripheral surface toward an outer peripheral surface of said intermediary transfer belt.

15. An image forming apparatus comprising:

a movable endless intermediary transfer belt;

first to fourth photosensitive drums which are arranged along said intermediary transfer belt in the order of said first photosensitive drum, said second photosensitive drum, said third photosensitive drum and said fourth photosensitive drum from an upstream side toward a downstream side with respect to a direction in which said intermediary transfer belt moves, and which contact said intermediary transfer belt, wherein toner images transferred from said first to fourth photosensitive drums onto said intermediary transfer belt at first to fourth primary-transfer portions, respectively, are transferred from said intermediary transfer belt onto a recording material at a secondary-transfer portion;

a plurality of supporting rollers, including a first supporting roller and a second supporting roller, configured to support said intermediary transfer belt, wherein said first to fourth photosensitive drums are arranged between the first supporting roller and the second supporting roller, and wherein in a case where said first to fourth photosensitive drums are viewed from a direction along rotational axes of said photosensitive drums, when a common tangential line, of two common tangential lines of said first to fourth photosensitive drums, positioned on a side where said first to fourth photosensitive drums contact said intermediary transfer belt is a reference line, each of the first supporting roller and the second supporting roller is disposed at a position so as to cross the reference line;

a constant voltage element which is electrically connected between said intermediary transfer belt and a ground potential and which maintains a predetermined voltage by passing of a current therethrough;

a voltage source configured to apply a voltage to a transfer member for transferring a toner image from said intermediary transfer belt onto the recording material to pass a current through said constant voltage element thereby to form a secondary-transfer electric field at the secondary-transfer portion and a primary-transfer electric field at the first to fourth primary-transfer portions; and a depressing member, provided in contact with an inner peripheral surface of said intermediary transfer belt between the second primary-transfer portion and the third primary transfer portion and disposed at a position where said depressing member crosses the reference line when said first to fourth photosensitive drums are viewed from a direction along the rotational axes of said photosensitive drums, said depressing member being configured to depress said intermediary transfer belt from the inner peripheral surface toward an outer peripheral surface of said intermediary transfer belt.

16. An image forming apparatus according to claim 15, wherein the first supporting roller is a roller, of the plurality of supporting rollers, closest to and upstream of the first primary-transfer portion with respect to the movement direction of said intermediary transfer belt, and the second supporting roller is a roller, of the plurality of supporting rollers, closest to and downstream of the fourth primary-transfer portion with respect to the movement direction of said intermediary transfer belt.

17. An image forming apparatus comprising:

a movable endless intermediary transfer belt;

first and second photosensitive drums which are arranged along said intermediary transfer belt, and which contact said intermediary transfer belt, wherein toner images transferred from said first and second photosensitive drums onto said intermediary transfer belt at first and second primary-transfer portions, respectively, are transferred from said intermediary transfer belt onto a recording material at a secondary-transfer portion;

a plurality of supporting rollers, including a first supporting roller and a second supporting roller, configured to support said intermediary transfer belt, wherein said first and second photosensitive drums are arranged between the first supporting roller and the second supporting roller, and wherein in a case where said first and second photosensitive drums are viewed from a direction along rotational axes of said photosensitive drums, when a common tangential line, of two common tangential lines of said first and second photosensitive drums, positioned on a side where said first and second photosensitive drums contact said intermediary transfer belt is a reference line, each of the first supporting roller and the second supporting roller is disposed at a position so as to cross the reference line;

a constant voltage element which is electrically connected between said intermediary transfer belt and a ground potential and which maintains a predetermined voltage by passing of a current therethrough;

a voltage source configured to apply a voltage to a transfer member for transferring a toner image from said intermediary transfer belt onto the recording material to pass a current through said constant-voltage element thereby to form a secondary-transfer electric field at the secondary-transfer portion and a primary-transfer electric field at the first and the second primary-transfer portions; and a depressing member, provided in contact with an inner peripheral surface of said intermediary transfer belt between the first primary-transfer portion and the second primary transfer portion and disposed at a position where said depressing member enters crosses the reference line when said first and second photosensitive drums are viewed from a direction along the rotational axes of said photosensitive drums, said depressing member being configured to depress said intermediary transfer belt from the inner peripheral surface toward an outer peripheral surface of said intermediary transfer belt.

* * * * *